US009599069B2

(12) United States Patent
Odillard et al.

(10) Patent No.: US 9,599,069 B2
(45) Date of Patent: Mar. 21, 2017

(54) COOLING DEVICE FOR AN ENGINE EXHAUST GAS RECIRCULATION CIRCUIT

(75) Inventors: Laurent Odillard, Le Luart (FR); Yoann Lemarchand, Fremecourt (FR); Olivier Latroy, St Germain en Laye (FR)

(73) Assignee: Valeo Systemes Thermiques, Le Mesnil Saint Denis (FR)

( * ) Notice: Subject to any disclaimer, the term of this patent is extended or adjusted under 35 U.S.C. 154(b) by 631 days.

(21) Appl. No.: 13/637,609

(22) PCT Filed: Mar. 28, 2011

(86) PCT No.: PCT/EP2011/054750

§ 371 (c)(1),
(2), (4) Date: May 14, 2013

(87) PCT Pub. No.: WO2011/120931

PCT Pub. Date: Oct. 6, 2011

(65) Prior Publication Data

US 2013/0220290 A1 Aug. 29, 2013

(30) Foreign Application Priority Data

Mar. 31, 2010 (FR) ..... 10 52413

(51) Int. Cl.
*F02M 25/07* (2006.01)
*F01P 7/16* (2006.01)

(52) U.S. Cl.
CPC ..... *F02M 25/0726* (2013.01); *F01P 7/165* (2013.01); *F02M 26/13* (2016.02); *F02M 26/22* (2016.02); *F02M 26/28* (2016.02)

(58) Field of Classification Search
CPC ..... F02M 25/0726; F02M 25/0704; F02M 25/0706; F02M 25/0712; F02M 25/0715;
(Continued)

(56) References Cited

U.S. PATENT DOCUMENTS 5,740,785 A * 4/1998 Dickey et al. ..... 123/568.12
2004/0107949 A1 6/2004 Miyoshi et al.
2008/0264609 A1* 10/2008 Lutz et al. ..... 165/104.19

FOREIGN PATENT DOCUMENTS

EP 0 763 655 A2 3/1997
FR 2 915 771 A1 11/2008
WO 2008/069743 A1 6/2008

OTHER PUBLICATIONS

International Search Report w/translation from PCT/EP2011/054750 mailed on May 19, 2011 (6 pages).

* cited by examiner

*Primary Examiner* — Jacob Amick
(74) *Attorney, Agent, or Firm* — Osha Liang LLP

(57) ABSTRACT

The invention relates to a cooling device for an engine (1) exhaust gas recirculation circuit, notably that of a motor vehicle, said circuit comprising a valve (2) for controlling the circulation of said gas, said device comprising a heat exchanger (3), known as the EGR exchanger, intended to allow an exchange of heat between the exhaust gases passing through said recirculation circuit and a coolant fluid, and means (4) of cooling said valve. According to the invention, said device comprises a cooling loop (5), known as a high-temperature cooling loop and configured so that said valve cooling means (4) have a first fluid passing through them, and a second cooling loop (12), known as a low-temperature cooling loop and configured so that the EGR exchanger (3) has passing through it a second fluid at a temperature lower than that of the first fluid. The invention also relates to an assembly of an exhaust gas recirculation circuit and of such a cooling device, and to a system for supplying an engine, notably a supercharged diesel engine, with charge gases and comprising an engine air supply circuit and such an assembly.

9 Claims, 1 Drawing Sheet

COOLING DEVICE FOR AN ENGINE EXHAUST GAS RECIRCULATION CIRCUIT

Figure 1:
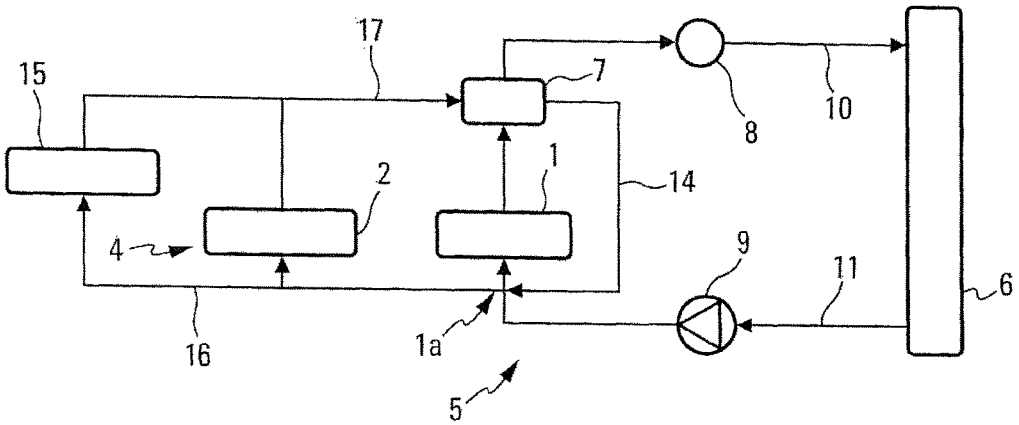

The present invention relates to a cooling device for an engine, notably motor vehicle engine, exhaust gas recirculation circuit. It also relates to an assembly of an exhaust gas recirculation circuit and of such a cooling device. It further relates to a system for supplying an engine, notably a supercharged diesel engine, with inlet gas, comprising a circuit for supplying air to said engine and such an assembly.

At the present time, it is known practice to bleed exhaust gases off from an engine and inject them into the inlet side of said engine, this being done with a view to reducing pollutant emissions. These gases are usually known as recirculated exhaust gases or EGR which stands for "Exhaust Gas, Recirculated". The flow of EGR to the inlet side is controlled by a valve and cooled by a heat exchanger known as the EGR exchanger.

Nowadays, the EGR exchanger and the valve are incorporated into one and the same cooling loop.

The Applicant has found that this presents numerous problems and the invention sets out to address these.

To do so, the invention relates to a cooling device for an engine, notably motor vehicle engine, exhaust gas recirculation circuit, said circuit comprising a valve for controlling the circulation of said gas, said device comprising a heat exchanger, known as an EGR exchanger, intended to allow an exchange of heat between the exhaust gases passing through said recirculation circuit and a cooling fluid, and means for cooling said valve.

According to the invention, said device comprises a cooling loop, known as a high-temperature loop, configured so that said valve cooling means have a first fluid passing through them and a second cooling loop, known as a low-temperature loop, configured so that a second fluid, intended to be at a temperature lower than that of the first fluid, passes through the EGR exchanger.

A "loop" means an assembly of equipments, notably exchangers, connected together directly or via hoses or the equivalent, said equipments and hoses having, passing through them, the fluid that passes through the loop. In other words, said high-temperature and low-temperature loops respectively incorporate the EGR circulation control valve cooling means and the EGR exchanger.

This then makes available a solution that does not disadvantage one single solitary cooling loop and allows the heat that is to be dissipated to be spread optimally. It also reduces the risks of fouling and of the formation of condensates at the valve. In addition, by limiting the cooling of the EGR in the region of the valve, it is possible to have EGR the cooling of which is limited, particularly in the event of two passes through the EGR exchanger, something which is of benefit for starting up catalytic converters used in engine exhaust lines to reduce pollution.

According to various embodiments:

said high-temperature and low-temperature loops each comprise a heat exchanger known respectively as a high-temperature and a low-temperature cooling radiator, allowing an exchange of heat between a stream of ambient air and, respectively, said first and second fluids, the low-temperature loop comprises an intercooler, said intercooler allowing an exchange of heat between the air that passes through an engine air supply circuit and the fluid of said low-temperature loop, the intercooler, the EGR exchanger and the low-temperature radiator are mounted in series in the direction in which the fluid flows in the low-temperature loop, the high-temperature loop comprises a heating radiator, said loop being configured to allow an exchange of heat between air passing through said heating radiator and the first fluid leaving said valve cooling means, so as to heat up the air that passes through said heating radiator.

The invention also relates to an assembly of an exhaust gas recirculation circuit comprising a valve for controlling the circulation of said gas, and of a device for cooling said circuit, as mentioned hereinabove.

According to one embodiment, said valve comprises a body and said means of cooling the valve consist of ducts, formed in said body so as to allow the first fluid to flow through said valve.

The invention also relates to a device for supplying an engine, notably a supercharged diesel engine, with inlet gas, comprising a circuit for supplying said engine with air and an assembly as described above, the exhaust gas recirculation circuit opening into said air supply circuit.

According to some embodiments:

said air supply circuit comprises a valve for controlling the circulation of the air, said system comprises a turbocharger having a turbine driven by the exhaust gases from the engine, and a compressor driven by said turbine to compress the air circulating through the supply circuit, said exhaust gas recirculation circuit bleeding exhaust gases off upstream of the turbine and introducing them into the air supply circuit downstream of the compressor.

Figure 2:
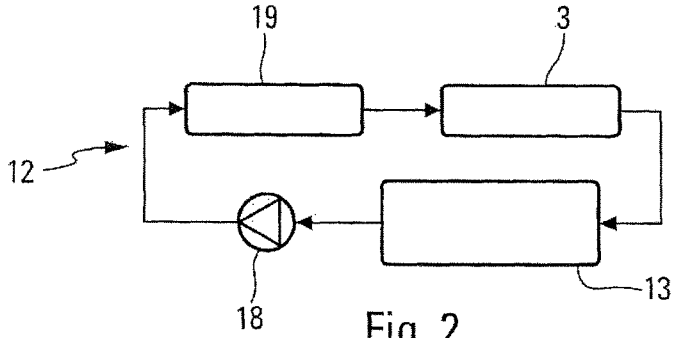
Figure 3:
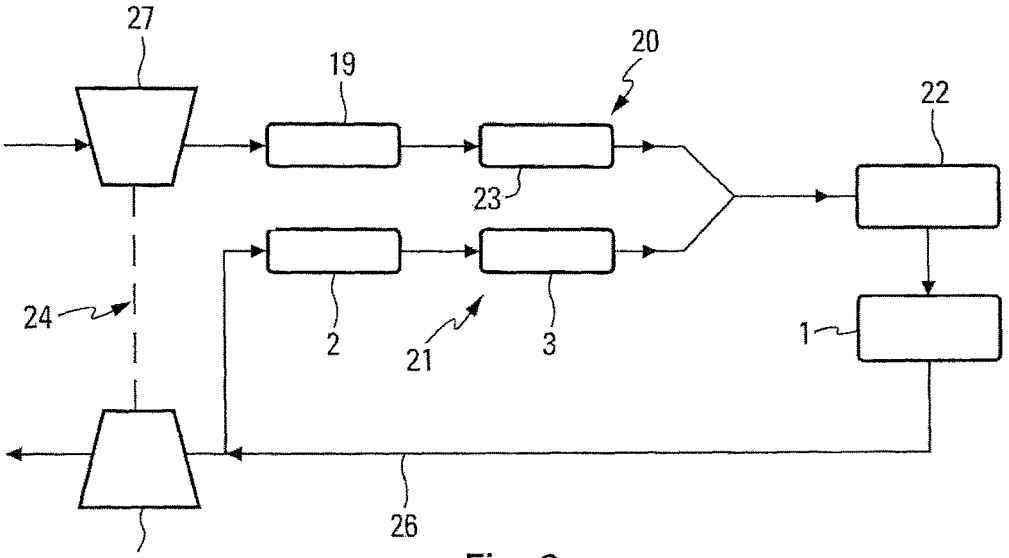

The invention will be better understood in the light of the following description which is given merely by way of indication without the intention to restrict it, and which is accompanied by the attached drawings in which:

FIGS. 1 and 2 respectively and schematically illustrate one example of a high-temperature and low-temperature loop of a cooling device according to the invention, FIG. 3 schematically illustrates one example of a vehicle inlet gas supply system according to the invention and associated with the cooling device illustrated in FIGS. 1 and 2.

As illustrated in FIGS. 1 and 2, the invention relates to a cooling device for a motor vehicle engine 1, notably combustion engine, for example diesel engine, exhaust gas recirculation circuit. As detailed below, said circuit comprises a valve 2 for controlling the circulation of said gas. Said valve 2 is designed, for example, to make it possible to regulate the flow rate of EGR passing through said circuit.

The device according to the invention comprises a heat exchanger 3, known as an EGR exchanger, intended to allow an exchange of heat between the exhaust gases passing through said recirculation circuit and a cooling fluid, and means 4 for cooling said valve 1 that controls the circulation of the EGR.

According to the invention, said device comprises a cooling loop 5, known as a high-temperature loop, illustrated more specifically in FIG. 1, through which a first fluid passes. It is configured, for example, to cool said engine 1 and may comprise a cooling radiator 6, known as a high-temperature cooling radiator, allowing an exchange of heat between a stream of ambient air and said first fluid.

Said high-temperature cooling loop further comprises, for example, a water outlet header 7, a thermostat 8 and a pump 9. The water outlet header 7 is mounted directly on the engine 1 and connected by a duct 10 to the high-temperature cooling radiator 6. There is a duct 11 between the high-temperature cooling radiator 6 and an inlet 1*a* for said first fluid into the engine 1.

The pump 9 is provided on the duct 11 that connects the high-temperature cooling radiator 6 and the engine 1, and the thermostat 8 is provided on the pipe 10 connecting the water outlet header 7 and the high-temperature cooling radiator 6.

The pump 9 causes fluid to circulate through said engine 1 where the first fluid cools the engine by picking up heat energy. The first fluid then enters the water outlet header 7 and, if the thermostat 8 is open, passes along the duct 10 connecting the water outlet header 7 and the high-temperature cooling radiator 6. It then enters said high-temperature cooling radiator 6 where it is cooled before returning to the engine along the pipe 11 connecting the high-temperature cooling radiator 6 and the engine 1.

The device according to the invention also comprises a second cooling loop 12, known as the low-temperature loop, detailed in FIG. 2, through which a second fluid passes. Said low-temperature loop comprises, for example, a cooling radiator 13, known as the low-temperature cooling radiator, allowing an exchange of heat between a stream of ambient air and the second fluid, intended to circulate through said radiator.

According to the invention, said high-temperature loop 5 is configured so that said means 4 that cool the valve 2 that controls the circulation of the EGR have the first fluid passing through them and said second loop is configured so that said second fluid, intended to be at a temperature lower than that of the first fluid, passes through the EGR exchanger 3.

This then improves the overall operation of the device by assigning the valve and the exchanger separate cooling circuits which can thus be better suited to them.

Said first and second fluids are, for example, heat-transfer fluids of the same chemical nature, such as water containing a glycol additive.

According to the embodiment illustrated, said high-temperature and low-temperature loops 5, 12 are independent and do not communicate with one another. However, provision could be made for said loops to communicate with one another, notably with a view to sharing the heat-dissipating capabilities of the high-temperature and low-temperature cooling radiators 6, 13.

Said high-temperature and low-temperature radiators 6, 13 are positioned relative to one another for example in such a way that one and the same stream of air passes through them, in series. In other words, they are positioned one behind the other in the direction in which the stream of air flows. Be that as it may, they could also be arranged one underneath the other. They form, for example, a module that can be attached as a single unit at the front of the vehicle.

Returning now to the high-temperature loop 5, this may further comprise a path 14 that bypasses a high-temperature radiator 6 and connects the water outlet header 7 and the inlet 1*a* for the first fluid to the engine 1. Said bypass path 14 is intended to have said first fluid passing through it when the thermostat 8 is closed, namely when the engine 1 does not need to be cooled.

According to the embodiment illustrated, the high-temperature loop 5 also comprises a heating radiator 15. This is, for example, a heating radiator of an installation providing climate control for the passenger compartment of the motor vehicle. Said loop 5 is configured to allow an exchange of heat between the air passing through said heating radiator 15 and the first fluid, leaving said valve 2 cooling means 4, so as to heat up the air passing through said heating radiator.

According to the example illustrated, said high-temperature loop 5 comprises a pipe 16 connecting, on the one hand, the inlet 1*a* of the first fluid to the engine and, on the other hand, an inlet of the first fluid to the valve 2 and an inlet of first fluid to the heating radiator 15. It also comprises a pipe 17 connecting, on the one hand, an outlet of the first fluid from the valve 2 and an outlet of the first fluid from the heating radiator 15 and, on the other hand, the water outlet header 7. In other words, the valve 2 and the heating radiator 15 are sited in parallel in the direction in which the first fluid flows. The heat energy dissipated by the valve 2 into the circuit can therefore reach the heating radiator 15, particularly via the bypass path 14.

Returning now to the low-temperature loop 12, this may comprise a low-temperature pump 18 for circulating the second fluid.

Said low-temperature loop 12 further comprises, for example, an intercooler 19. The latter is intended to allow an exchange of heat between the air that passes through an engine 1 air supply circuit and the fluid of said low-temperature loop 12.

According to the embodiment illustrated, the intercooler 19, the EGR exchanger 2 and the low-temperature radiator 13 are mounted in series in the direction in which the fluid flows in the low-temperature loop 12.

The invention also relates to an assembly of an exhaust gas recirculation circuit comprising a valve 2 for controlling the circulation of said gas, and of a device for cooling said circuit, as described hereinabove.

Said valve 2 comprises, for example, a body and said means 4 of cooling the valve 2 consist of ducts, not depicted, formed in said body so as to allow the first fluid to flow through said valve 2.

As illustrated in FIG. 3, the valve 2 and the EGR exchanger are mounted in series, in this order, in the direction in which the EGR flows.

Although this has not been depicted, there may be a duct that allows the EGR to bypass the EGR exchanger, and a valve, known as a bypass valve, that opens or closes said bypass duct. To cool it, said bypass valve may be incorporated into said high-temperature loop.

The invention also relates to a system for supplying inlet gases to an engine, notably a supercharged diesel engine.

Referring once again to FIG. 3, it may be seen that said supply system comprises a circuit 10 for supplying air to said engine and an assembly as described above. The exhaust gas recirculation circuit of said assembly, illustrated as 21, opens into said air supply circuit 20, for example at a manifold 22 that distributes the inlet gases to the engine 1.

Said air supply circuit comprises, for example, a valve 23 for controlling the circulation of the air and which notably regulates the flow rate of air and/or contributes to regulating the EGR flow rate, in concert with the valve 2 of the exhaust gas recirculation circuit 21.

Said system could further comprise a turbocharger 24, having a turbine 25, situated in the path 26 along which the exhaust gases leaving the engine 1 pass and driven by these gases, and a compressor 27 driven by said turbine 25 to compress the air flowing through the supply circuit. Said exhaust gas recirculation circuit 21 bleeds exhaust gases off upstream of the turbine 25 and introduces them into the air supply circuit 20 downstream of the compressor 27.

In said air supply circuit 20, the intercooler 19 and the valve 23 that controls the circulation of the air are provided, for example, in series, in this order, in the direction in which the air in said inlet circuit 20 flows, this being between the turbine 27 and the point at which the EGR is injected into said supply circuit 20.

The invention claimed is:

1. A cooling device for a motor vehicle engine exhaust gas recirculation circuit, said circuit comprising a valve for controlling the circulation of said gas, said cooling device comprising:

an EGR heat exchanger configured to allow an exchange of heat between exhaust gases received directly from the motor vehicle engine, passing through said recirculation circuit and a cooling fluid;

means for cooling said valve;

a high-temperature cooling loop configured so that said valve cooling means have a first fluid passing through; and a low-temperature cooling loop comprising an intercooler, the EGR exchanger, and a low-temperature radiator mounted in series in a direction of fluid flow in the low-temperature cooling loop, wherein the low-temperature cooling loop is configured so that a second fluid, at a temperature lower than that of the first fluid, passes through the EGR heat exchanger.

2. The device as claimed in claim 1, wherein said high-temperature comprises a high-temperature heat exchanger, wherein the-low-temperature cooling radiator and the high-temperature heat exchanger, respectively, exchange heat between a stream of ambient air and, respectively, said first and second fluids.

3. The device as claimed in claim 2, wherein the intercooler exchanges heat between the air that passes through an engine air supply circuit and the second fluid.

4. The device as claimed in claim 1, wherein the high-temperature loop comprises a heating radiator, said loop being configured to allow an exchange of heat between air passing through said heating radiator and the first fluid leaving said valve cooling means to heat up the air that passes through said heating radiator.

5. An assembly of an exhaust gas recirculation circuit comprising:

a valve for controlling the circulation of said exhaust gas; and a device for cooling said circuit as claimed in claim 1.

6. The assembly as claimed in claim 5, wherein said valve comprises a body and said means of cooling the valve comprises ducts, formed in said body so as to allow the first fluid to flow through said valve.

7. A system for supplying a supercharged diesel engine with inlet gas, comprising:

an air supply circuit for supplying said engine with air; and an assembly of an exhaust gas recirculation circuit opening into said air supply circuit comprising a valve for controlling the circulation of said exhaust gas and a cooling device as claimed in claim 1.

8. The system as claimed in claim 7, wherein said air supply circuit comprises a valve for controlling the circulation of the air.

9. The system as claimed in claim 7, further comprising:

a turbocharger having a turbine driven by the exhaust gases from the engine; and a compressor driven by said turbine to compress the air flowing through the supply circuit, said exhaust gas recirculation circuit bleeding exhaust gases off upstream of the turbine and introducing them into the air supply circuit downstream of the compressor.

* * * * *